US006836912B1

(12) United States Patent
Morris

(10) Patent No.: US 6,836,912 B1
(45) Date of Patent: Jan. 4, 2005

(54) FURNITURE

(76) Inventor: Danny Morris, Free Spirit, 9C McIandra Road, Stanmore Bay, Hibiscus Coast, 1463 (NZ)

( * ) Notice: Subject to any disclaimer, the term of this patent is extended or adjusted under 35 U.S.C. 154(b) by 0 days.

(21) Appl. No.: 10/019,942

(22) PCT Filed: Jun. 29, 2000

(86) PCT No.: PCT/NZ00/00115

§ 371 (c)(1),
(2), (4) Date: Apr. 29, 2002

(87) PCT Pub. No.: WO01/03550

PCT Pub. Date: Jan. 18, 2001

(30) Foreign Application Priority Data

Jul. 7, 1999 (NZ) ..... 336603

(51) Int. Cl.[7] ..... A47C 19/04; A47C 27/00

(52) U.S. Cl. ..... 5/181; 5/183; 5/202; 5/507.1; 5/737; 5/722; 5/286; 5/655; 5/706

(58) Field of Search ..... 5/181, 183, 202, 5/200.1, 201, 503.1, 507.1, 737, 722, 285, 286, 282.1, 2.1, 665, 706

(56) References Cited

U.S. PATENT DOCUMENTS

| | | | | |
|---|---|---|---|---|
| 402,129 | A | * | 4/1889 | Bracket |
| 611,115 | A | * | 9/1898 | Furnivau et al. |
| 1,259,022 | A | * | 3/1918 | Kran et al. |
| 3,871,039 | A | | 3/1975 | Garceaue t al. |
| 4,192,028 | A | | 3/1980 | Knoke |
| 4,295,234 | A | | 10/1981 | Whitehead |
| 4,679,261 | A | | 7/1987 | Stanley et al. |

FOREIGN PATENT DOCUMENTS

EP 0 116 184 A1 8/1984

* cited by examiner

*Primary Examiner*—Alexander Grosz
(74) *Attorney, Agent, or Firm*—Young & Thompson

(57) ABSTRACT

A furniture item includes at least a pair of members defining a dimension in one direction of the item, the members of the pair being connected together by adjustable connecting elements, the arrangement and construction being such that the dimension in one direction can be adjusted by the adjustable connecting elements. The furniture item also includes a second set of members that are also connected by adjustable connecting elements in another direction. With the above arrangement, the furniture item can be adjusted both longitudinally and laterally.

12 Claims, 3 Drawing Sheets

FURNITURE

TECHNICAL FIELD OF THE INVENTION

This invention relates to adjustable furniture. For convenience only, the present invention will be described with reference to furniture such as beds for which the invention may be particularly applicable. However, it is to be understood that it is not to be limited as such. Moreover, because the invention may have other applications it is to be understood that the background art and possible embodiments of the invention as discussed below are given by way of example only.

BACKGROUND ART

Traditionally, beds have been made to only a few specific sizes depending on requirements. For example, a cot for babies, a single bed for one person, or a double bed for two people, the double bed being either a large "king" size or a slightly smaller "queen" size.

Due to these set sizes, people are left with little choice of alternative sizes to suit their individual requirements. For example, it may be necessary to buy an adult size bed for a child's room where this size may not be required until several years later. Hence, space in the room which may have more appropriate uses when the child is young, is unnecessarily taken up by the bed. Moreover, in designing a bedroom the architect may be constrained by the fixed size of the bed so that it is difficult to optimize the design.

Furthermore, in the case where a cot is provided for a child, this may only be suitable for a short period of childhood, after which a larger bed must be bought. Not only does this involve extra costs, but a child may also be reluctant to part with his/her bed. Folding beds and modular type beds (i.e. beds where a base may be slid under the bed) do address some aspects of the problem with fixed sized beds in that a double size bed can be folded or stowed away so as to only take up the space of a single size bed. However, the bed size is still limited to a standard length and width so that the size of the bed cannot always be optimized.

Similar problems with obtaining optimum sizing of furniture to suit a room or to suit changing requirements may also arise with various other types of furniture such as couches, tables, bookcases and the like. These too, as with beds, are of fixed dimensions once assembled thus putting a constraint on the design of a room, and may with time become too large or too small for requirements. Moreover, they may no longer be required for their initial function, and simply take up space.

Another problem with fixed sized furniture arises when installing the furniture in the room. Since the size is fixed, it may be difficult or impossible to carry the furniture in its assembled form into the room due, for example, to narrow doorways, or staircases, thus making it difficult to install or rearrange such furniture.

Furthermore, items of furniture which are no longer required, such as beds for occupants which have left, take up space or must be stored. There is a need to be able to continue to use these items of furniture such as by converting them to other furniture. For example, a bed could be converted into a dining table, a couch, a coffee table, etc.

OBJECT

It is therefore an object of the present invention to provide various types of furniture which address the above problems or at least provide the public with a useful choice. It is another object of the present invention to provide furniture constructed so that the size thereof can be easily varied, to give a wide range of sizes to suit varying requirements, and which can also be converted to other items of furniture.

DISCLOSURE OF THE INVENTION

According to one aspect of the present invention, there is provided a furniture item comprising: at least a pair of members defining a dimension in one direction of said item, the members of said pair being connected together by adjustable connecting means, the arrangement and construction being such that said dimension in one direction can be adjusted by means of said adjustable connecting means.

According to another aspect of the present invention, there is provided a furniture item substantially as described above further comprising at least a second pair of members defining a dimension in a second direction substantially perpendicular to said one direction, the members of said second pair being connected together by a second adjustable connecting means, the arrangement and construction being such that said dimension in said second direction can be adjusted by means of said second adjustable connecting means.

The invention may be applicable to a variety of furniture items where it is desirable to be able to change the dimensions. For example, the furniture item may be a book case and the dimension in one direction may be a width or a height of the book case. Alternatively, the furniture item may be a bed, with the dimension being a length or width of the bed.

The adjustable connecting means may involve any device or devices whereby the members may be optionally located in a plurality of positions relative to each other. For example, this may involve linkage means connected between members of the pair, the arrangement and construction being such that the members may be located relative to each other in a plurality of configurations.

A suitable linkage arrangement may involve linkages such as found with folding beds. In this case, linkages may be arranged such that the width of the furniture item may be set to a range of widths, rather that the two widths provided by a conventional folding bed.

Alternatively or in addition, the adjustable connecting means may involve a sliding element fixedly connected relative to one of the members, and slidably engaged with an element fixedly connected relative to another of the members, the arrangement and construction being such that when the elements are slid relative to each other, the members are constrained to move relative to each other along a substantially straight line.

In the case of such a sliding element fixedly connected relative to one of the members, this may be of any suitable section which may be engaged with a complementary surface formed on the other member. For example, this may involve an angle or channel, which engages with a pin or pins on the other member, or a cylindrically shaped member which slides inside an aperture or tube formed on the other member.

The adjustable connecting means may also involve locking means for locking the elements or members relative to each other in a plurality of configurations. For example, this may involve clamping means which depend on frictional forces between adjacent surfaces, or fastening devices which positively locate the elements or members relative to each other, or a combination of both.

The members may thus be fastened together at different relative locations to each other, enabling variation in the dimension or dimensions of the furniture item. The connecting means may also make use of other items in a room to provide location of the members relative to each other. For example, locational forces may be provided by frictional forces between item and the floor.

Various types of fastening and clamping devices are possible. For example, these may involve the use of pins or bolts which fit into apertures provided at a plurality of locations on the elements. A possible arrangement may be similar to that used for telescopic tripods or tent poles where a pin provided inside one tubular member is resiliently biased so as to spring out and engage in an aperture in the telescoping member. The fastening and clamping device may also involve threaded members which may be tightened to clamp contacting surfaces of the elements together.

Friction members may also be provided to improve the locking effect. For example in the case of tubular members, "O" rings may be used. In this case, one possible arrangement may involve an "O" ring which is slidable along a tubular member which fits inside a larger diameter pipe having a flared inlet for accommodating the "O" ring, the arrangement being such that movement in one direction forces the "O" ring tight against the outer surface of the tubular member and the flared surface of the pipe, thus preventing relative movement in that direction.

Alternatively, a Crox nut type pipe coupling may be used with an "O" ring nipple, the "O" ring being clamped against the sliding surface with tightening of the coupling.

Members and elements of the furniture item may be made from a variety of materials as required or desired. In this respect, the design and function of the adjustable connecting means may be chosen to suit the type of materials used. For example, in the case of a bed using metal or plastic tube for the frame, the connecting means may involve telescoping portions of the metal or plastic tube with metal or plastic tube type couplings. With a metal bed having for example angle or channel section structural members, the connecting means may involve elongate slots formed in sections of the members, with threaded pins fixed to the mating members, and fitted with wing nuts which may be tightened to clamp the members together at optional relative positions. In the case of a bed with wooden slats for the mattress support, the adjustable connecting means may involve flexible bands such as "O" rings which resiliently hold portions of the slats together while allowing limited relative movement therebetween in a lengthwise direction of the slats.

In the case of a wooden book case, the connecting means may involve elongate slots formed in sections on one structural member of the book case and threaded pins fixed to the mating portions on another structural member of the book case, and fitted with wing nuts which may be tightened to clamp the members together at optional relative positions.

In the case of an adjustable bed, a mattress for the bed may be constructed so that the size thereof can be changed to suit the adjusted size of the bed. Suitable materials for the mattress may involve foam, air, water and more traditional materials. The mattress design may involve a modular construction so that sections may be added or removed as required. In this case, a mattress cover may be provided which can accommodate the largest anticipated size, and portions of the cover can be folded under the mattress when the mattress size is reduced.

Sections of the mattress may be connected by any suitable means. For example, in the case of a foam type mattress, this may involve interlocking sections formed on the edges of the mattress sections. A suitable type of interlocking may involve for example, protruding and recess portions such as found on bubble packaging or soundproofing foam. An adjustable thick cover (eg. padded calico or thick cotton) may also be used to cover any additional sections, preventing slippage and any unevenness, thus giving the overall appearance and feel of a traditional mattress.

In the case of water mattresses, a standard sectional water mattress can be utilized with additional compartments being filled, as and when required. Similarly with air mattresses, the size can be adjusted by inflating additional compartments.

As well as addressing the above problems encountered with fixed dimension type furniture, the present invention may also open up other aspects related to the uses of furniture which have not heretofore been considered. For example, a bed of variable dimensions may be made in the form of a house which could be extended to make a mansion, a bed representing a fort could be transformed into a castle, a bed in the form of a mini car could be transformed into one in the form of a stretch limousine. Additional accessories may also be added accordingly; for example, book cases, writing desks, etc. A bed in the form of a fort could have a drawbridge which becomes a desk.

According to a further aspect of the invention, there is provided a convertible furniture item including in combination, one or more tubular frame members adapted to be extensible in one or more directions, extensible post members adapted to be connected to and to support the frame members at various distances above floor level, the frame members further adapted to be connected to one or more conversion members adapted to convert one furniture item to a different furniture item, for example, a bed to a table, a dining table to a sofa or chair or a coffee table to a dining table.

Preferably, the one or more frame members are adjustable by means of telescoping tubular members extensible to predetermined length intervals wherein they are held in position by one or more detent mechanisms.

Preferably, the detent mechanisms are spring loaded pins located in an inner telescoping tube member adapted to engage a corresponding hole or slot in an outer telescoping tube member for holding the telescoping tubes at a predetermined length.

In the alternative, there are no detent mechanisms to hold the telescoping tubes in position but are held in position by the sheer weight of the frame member(s).

Preferably, the conversion members include headboards, sideboards, interlocking slats or platform members adapted to convert one item of furniture into another.

Conveniently, the conversion members are also extensible adjustable to correspond to the extension adjustable to correspond to the extension of the frame member(s).

Preferably, there are accessory fittings adapted to be detachably fitted to the frame members or conversion members, for example, a pivoting reading lamp, a writing table, a tray or a support for a television set, video recorder or personal computer, etc.

BRIEF DESCRIPTION OF THE DRAWINGS

Further aspects and advantages of the present invention will become apparent from the ensuing description which is given by way of example only and with reference to the accompanying drawings in which.

PREFERRED EMBODIMENT

Example 1

Figure 1:
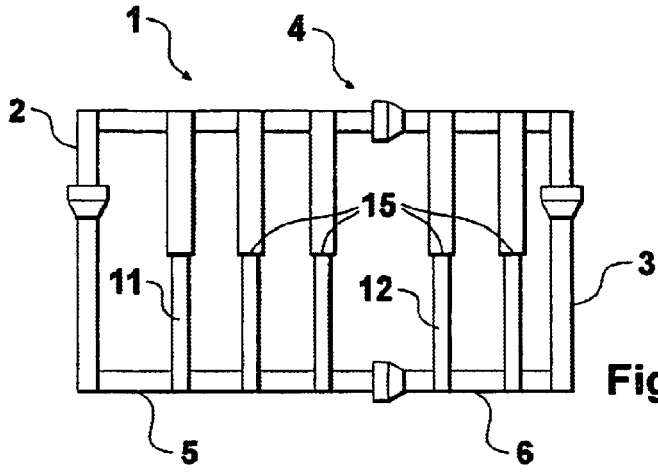
FIG. 1: is a schematic plan diagram of an adjustable bed according to an embodiment of the present invention showing a plan view according to Example 1.
Figure 2:
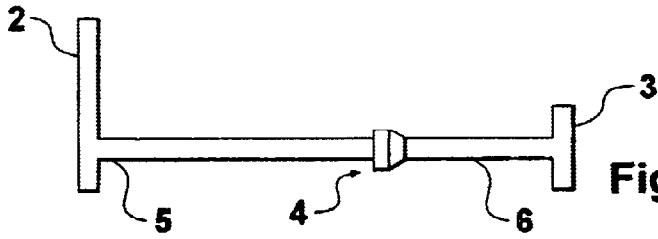
FIG. 2: is a side view of the bed of FIG. 1.
Figure 3:
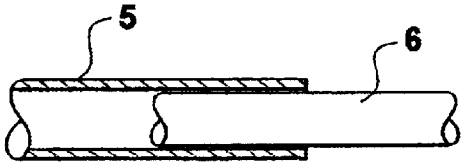
FIGS. 3 and 3*a:* are enlarged views of a typical connecting device.
Figure 3A:
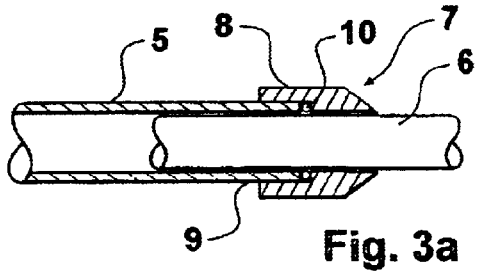

With reference to FIGS. 1 to 5, there is shown a furniture item according to Example 1 of the present invention in the form of a bed generally indicated by arrow 1. The bed 1 comprises a first pair of members defining therebetween a longitudinal direction of the bed, in the form of a bed head 2 and a bed foot 3. The bed head 2 and bed foot 3 are connected together by adjustable connecting devices generally indicated by arrow 4 provided on either side of the bed 1. As shown in detail in FIG. 3*a,* each of the connecting devices 4 comprise a portion of an outer tube 5 connected to the bed head 2 and a portion of an inner tube 6 connected to the bed foot 3. The diameters of the portions of the tubes 5, 6 are such that the tube 6 can slide freely inside tube 5 while being constrained thereby so as to move along its longitudinal axes.

The connecting devices 4 also comprise a locking coupling in the form of a Crox coupling generally indicated by arrow 7 having a nut portion 8 which is threaded onto a threaded portion 9 formed on the end of the tube 5, with an "O" ring 10 fitted inside the nut portion 8. The "O" ring 10 fits snugly around the tube 6 and is clamped tightly against the tube 6 when the nut 10 is tightened onto the thread 5, thereby locking the tube 6 relative to the tube 5.

With this arrangement, the distance between the bed ends 2 and 3 may be adjusted to a required length in a longitudinal direction, by sliding the pipe 6 inside the pipe 5. The bed ends 2 and 3 can then be locked in position relative to each other by tightening the coupling 7.

The bed is also provided with a number of cross members 11 and 12 to provide support for the mattress of the bed. The cross members 11 are fixedly connected at predetermined spacing to the pipe 5, while some or all of the cross members 12 may be slidably fitted to the pipe 6. This enables the spacing of the cross members 12 to be adjusted to suit the length of the bed 1.

To ensure a desired spacing of the cross members 12 with different degrees of extension of the bed 1, a suitable location device may be used. For example, this may involve protrusions on the pipe 6 which locate the ends of the cross members 12 at the required spacing. Alternatively, a flexible member may be tied between the cross members 12 so that as the bed 1 is increased in length, the cross members 12 are separated from each other, while as the bed 1 is decreased in length the cross members 12 are able to lie closer to each other.

Although not shown in the drawings, additional leg supports may be provided if required at intermediate portions along the pipe member 5. These may be pivotally attached to the pipe member 5 and folded down to give additional support when the bed is in an extended condition.

Figure 4:
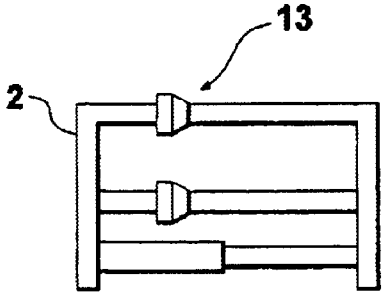
FIG. 4: is a head end view of the bed of FIG. 1.
Figure 5:
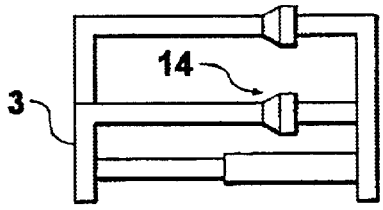
FIG. 5: is a foot end view of the bed of FIG. 1.
Figure 6:
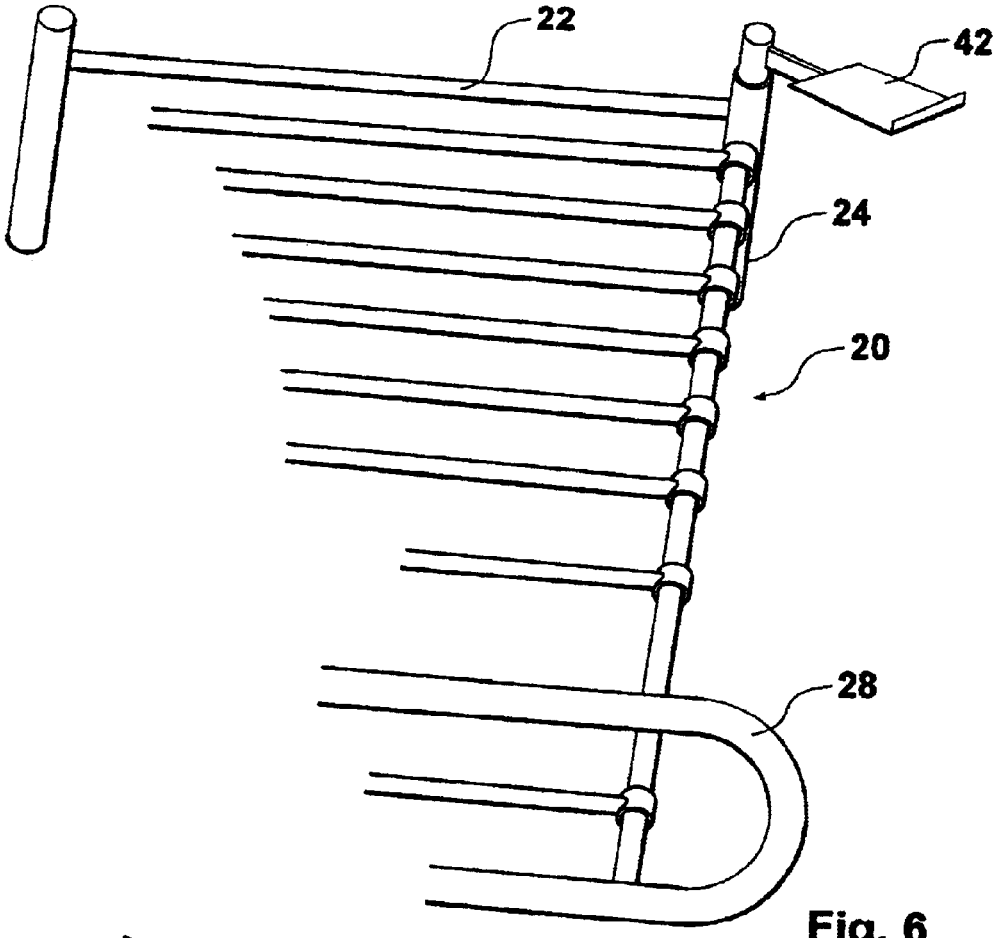
FIGS. 6, 7, 8, and 9: are perspective views of the invention according to Example 2.
Figure 7:
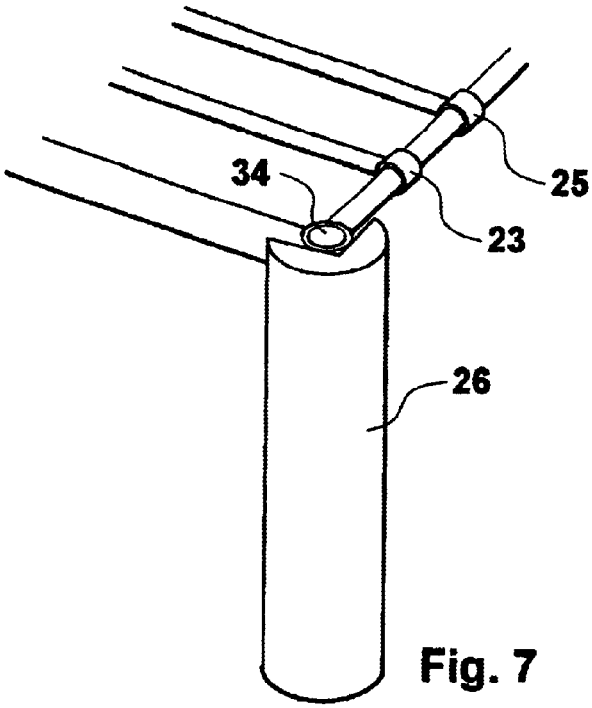
Figure 8:
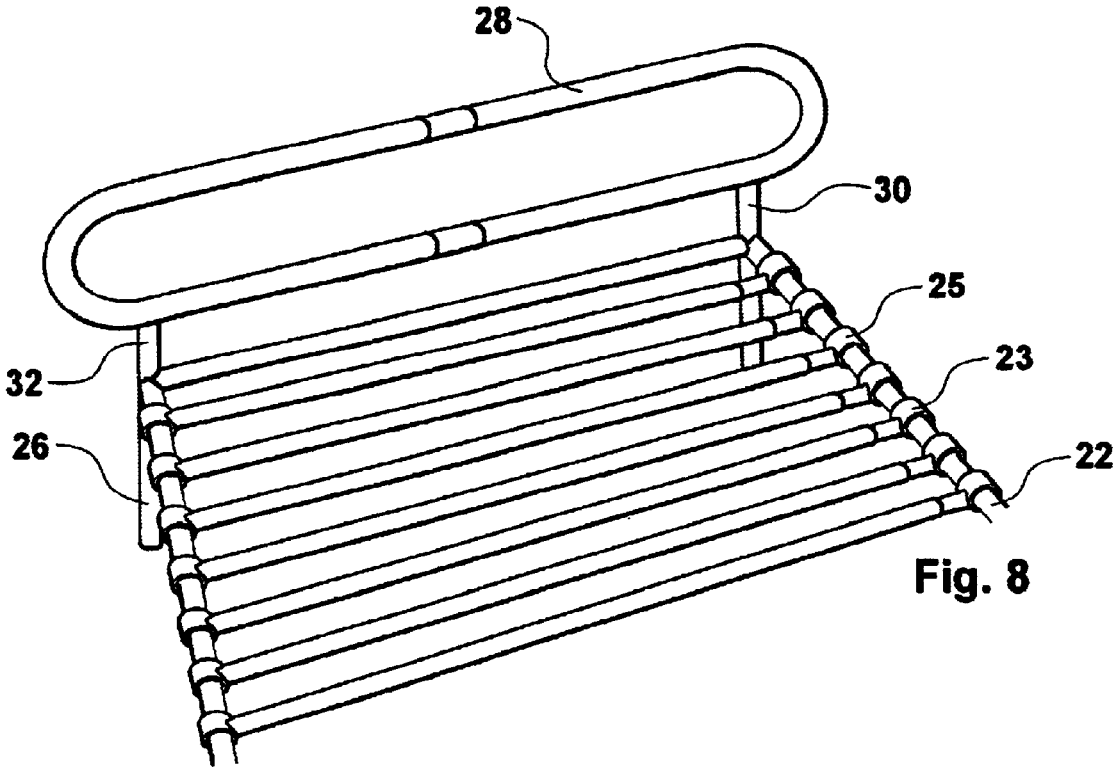
Figure 9:
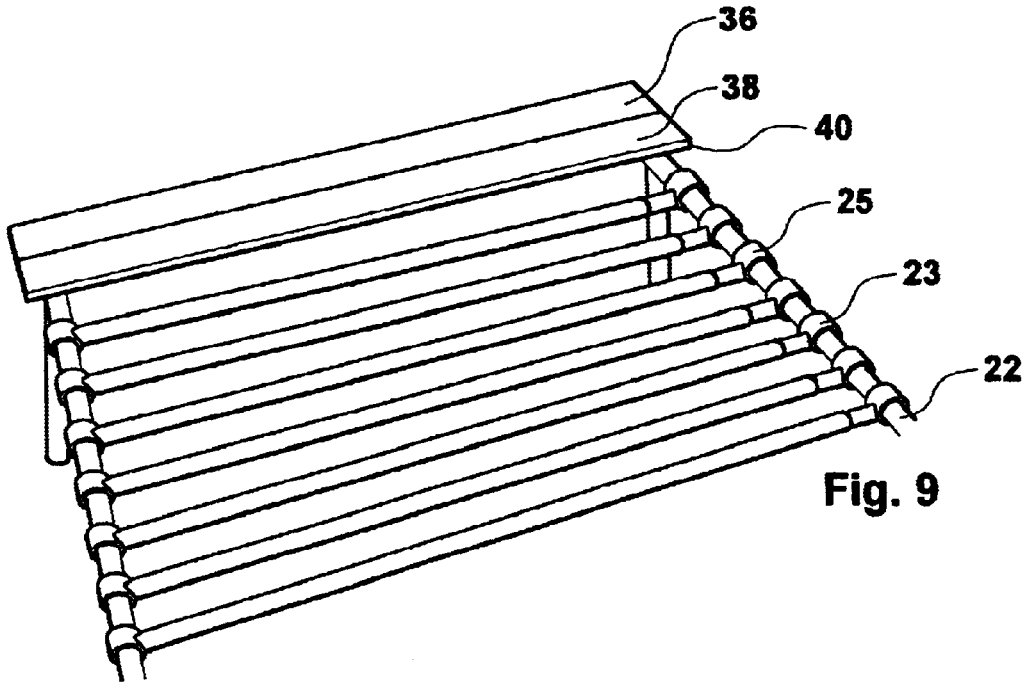

With the present embodiment, the width of the bed 1 is also adjustable in a similar manner. As shown in FIG. 4 and FIG. 5, the bed head 2 and bed foot 3 are each made up as two sections which are connected together by a second pair of adjustable connecting devices generally indicated by arrow 13 and 14. These connecting devices 13 and 14 are similar in design and function to the connecting devices 7 except that the dimensions of the telescoping pipe sections may be different depending on the design and strength requirements. Moreover, the cross members 11 and 12 are formed with telescoping tubular sections 15 which can telescope inside each other as the width of the bed 1 is changed.

With such an arrangement, the width of the bed as well as the length can be adjusted to suit requirements.

For example, the bed can be made smaller for transport or installation, and then expanded to a desired size once installed.

The bed can also be extended or widened to suit the size of children as they grow, or can be easily adjusted at any time as may be required by children when playing. Moreover, the size of the bed can be easily increased or decreased as required to suit individual requirements.

Various types of mattress design may be used with the bed. For example, a foam mattress 50 of modular construction may be used, and sections may be added or removed as required. The mattress 50 for the bed may be made of a modular construction so that separate modules may be connected or removed as required to suit the different sizes of the bed. A mattress cover 51 may be provided which can accommodate the largest anticipated size. The cover 51 may be used to prevent slippage and any unevenness.

Example 2

FIGS. 6, 7, 8 and 9 show a preferred embodiment of the invention according to Example 2 in the form of a bed 20 which can be converted to other items of furniture. The bed preferably has a frame 22 of powder coated steel tube, however other tubing such as aluminum, copper or plastic tube may be used. The tubular frame is extensible lengthwise and breadthwise with sliding cross members 23, 25 which are spaced by linkage means 55 in the form of a chain (not shown) and is supported by extensible post members 24 which can be screwed to the frame. The extensible post members allow the bed to be converted to a dining table or a coffee table and are major conversion members. The post members in some models, may be covered by a cosmetic member 26 into which the post member is inserted. Also shown is an adjustable headboard 28 which can be extended to accommodate different widths of the bed. The headboard has a projection 30, 32 or stumps which are insertable into sockets 34 in the frame. The bed has wooden slats 36, 38 which have complementary fitting tongue and groove edges 40 so that as the bed is lengthened, additional slats can be added to end piece slats 36. The end piece slats have rubber plugs (not shown) which are insertable into sockets at the ends of the bed. The slats also provide the top of a dining or coffee table and can have a painted or polished finish surface. In the alternative to a slotted top, an integral top of metal or panel board or wood can be used (not shown). Accessory fittings in the form of pivoting support stands 42 for portable or television receivers or computer monitors can also be removably attached the frame.

Advantages

We believe the advantages of our invention to be as follows, however it should be appreciated that all such advantages may not be realized on all embodiments of the invention, and the following list is therefore given by way of example only as being indicative of potential advantages of the present invention. Furthermore, it is not intended that the advantages of the present invention be restricted to those of the list which follows.

1. The sizes of furniture items can be easily adjusted to suit requirements, thus extending the range of application of a particular type of item.

2. In the case of a bed, this can be easily changed in size to suit requirements.

3. Items of furniture can easily be converted to other items of furniture according to changing needs.

Aspects of the present invention have been described by way of example only and it should be appreciated that modifications and additions may be made thereto without departing from the spirit or scope as herein set forth in the claims.

Throughout the description and claims of this specification, the word "comprise" and variations of that word, such as "comprises" and "comprising", are not intended to exclude other additives, components, integers or steps.

What is claimed is:

1. An article of furniture having a substantially planar frame capable of supporting a mattress, wherein the planar frame is made up of a first and a second sub-frame, the first sub-frame having a first and a second outer longitudinal tube, at least three first telescopic transverse members fixedly attached to the pair of outer longitudinal tubes, one end of each first telescopic transverse member being attached to the first outer longitudinal tube and the other end of each first telescopic transverse member being attached to the second outer longitudinal tube, the first sub-frame having attachment means for the attachment of at least a pair of legs and having socket means adapted to receive frame members which extend out of the plane of the first sub-frame, the second sub-frame having a first and a second inner longitudinal member, each being capable of telescoping within the said outer longitudinal tubes, and a plurality of second telescopic transverse members slidably attached to the pair of inner longitudinal members, one end of each second telescopic transverse member being attached to the first inner longitudinal tube and the other end of each second telescopic transverse member being attached to the second inner longitudinal tube, the second sub-frame also having attachment means for the attachment of at least a pair of legs and having socket means adapted to receive frame members which extend out of the plane of the second sub-frame, whereby in one embodiment the article of furniture can be configured as a bed, and in another embodiment can be configured as a chair.

2. An article of furniture as claimed in claim 1, wherein a flexible linkage is connected to adjacent second telescopic transverse members to link the adjacent second telescopic transverse members of the second sub-frame and the flexible linkage is adapted to limit the maximum spacing between the adjacent second telescopic transverse members to ensure that the article of furniture remains capable of supporting a mattress even when the planar frame is fully extended longitudinally.

3. An article of furniture as claimed in claim 1, wherein the article of furniture includes a locking means which is adapted to lock at least one inner longitudinal tube relative to a mating outer longitudinal tube.

4. An article of furniture as claimed in claim 1, wherein the article of furniture includes a locking means which is adapted to lock at least one telescopic transverse member to prevent extension or retraction of the telescopic transverse member.

5. An article of furniture as claimed in claim 1, wherein the article of furniture includes a mattress which is adjustable in size.

6. An article of furniture as claimed in claim 5, wherein the mattress is of modular construction such that sections of the mattress can be added or removed as required.

7. An article of furniture as claimed in claim 6, wherein a mattress cover is provided which can accommodate the largest anticipated size of the mattress, and portions of the cover can be folded away when the size of the mattress is reduced.

8. An article of furniture as claimed in claim 6, wherein the mattress is a foam type mattress having interlocking sections on the edges of the mattress sections.

9. An article of furniture as claimed in claim 7, wherein the cover is adapted to prevent slippage and any unevenness between modular sections of the mattress.

10. An article of furniture as claimed in claim 5, wherein the mattress is a water mattress with compartments which can be filled as required to increase the size of the mattress.

11. An article of furniture as claimed in claim 5, wherein the mattress is an air mattress, the size of which can be adjusted by inflating additional compartments.

12. An article of furniture as claimed in claim 1, wherein frame members which can extend out of the plane of the first and second sub-frames are provided, the frame members being selected from the group including headboards, sideboards, armrests, and platform members, the frame members being adapted to convert the article of furniture from one item of furniture into another.

* * * * *

UNITED STATES PATENT AND TRADEMARK OFFICE

CERTIFICATE OF CORRECTION

PATENT NO. : 6,836,912 B1
DATED : January 4, 2005
INVENTOR(S) : Danny Morris

It is certified that error appears in the above-identified patent and that said Letters Patent is hereby corrected as shown below:

Title page,
Item [76], Inventors, change "McIandra Road, Stanmore Bay" to -- Melandra Road, Stanmore Bay --.

Signed and Sealed this

Seventeenth Day of May, 2005

JON W. DUDAS
*Director of the United States Patent and Trademark Office*